US008417138B2

(12) United States Patent
Kitahara

(10) Patent No.: US 8,417,138 B2
(45) Date of Patent: Apr. 9, 2013

(54) FIXING DEVICE USING ELECTROMAGNETIC INDUCTION HEATING METHOD

(75) Inventor: Toshihiko Kitahara, Tokyo (JP)

(73) Assignee: Canon Kabushiki Kaisha (JP)

( * ) Notice: Subject to any disclaimer, the term of this patent is extended or adjusted under 35 U.S.C. 154(b) by 319 days.

(21) Appl. No.: 12/872,439

(22) Filed: Aug. 31, 2010

(65) Prior Publication Data

US 2011/0052238 A1 Mar. 3, 2011

(30) Foreign Application Priority Data

Sep. 1, 2009 (JP) ..... 2009-201495

(51) Int. Cl.
*G03G 15/20* (2006.01)

(52) U.S. Cl. ..... 399/69

(58) Field of Classification Search ..... 399/67, 399/69

See application file for complete search history.

(56) References Cited

U.S. PATENT DOCUMENTS 6,097,926 A * 8/2000 Takagi et al. ..... 399/328
2010/0150597 A1* 6/2010 Kinouchi et al. ..... 399/69

FOREIGN PATENT DOCUMENTS

JP 2006-154222 A 6/2006
JP 2007-057672 A 3/2007

* cited by examiner

*Primary Examiner* — Walter L Lindsay, Jr.
*Assistant Examiner* — Frederick Wenderoth
(74) *Attorney, Agent, or Firm* — Rossi, Kimms & McDowell LLP

(57) ABSTRACT

A fixing device which makes it possible to reduce power consumption during a non-fixing operation while reducing the time before fixing is started. A belt has a conductive layer provided thereon. A pressure roller is rotated in a state engaged with the belt to thereby cause the belt to be rotated in a driven manner. Exciting circuits each formed by a magnetic core and an exciting coil generate an eddy current in the conductive layer provided on the belt to thereby cause heat to be generated in the conductive layer. A plurality of the exciting circuits are arranged at different locations along a rotational direction of the belt, and a controller drivingly controls the exciting circuits in respective timings in a state where the belt and the pressure roller are disengaged from each other.

4 Claims, 10 Drawing Sheets

FIXING DEVICE USING ELECTROMAGNETIC INDUCTION HEATING METHOD

BACKGROUND OF THE INVENTION

1. Field of the Invention

The present invention relates to a fixing device that uses an electromagnetic induction heating method.

2. Description of the Related Art

Conventionally, a general image forming apparatus is equipped with a fixing device for melting toner of a toner image transferred on a recording sheet as a member on which the toner image is to be fixed, by heat, and fixing the same on the recording sheet. In recent years, as the fixing device, there has been often employed one that uses an electromagnetic induction heating method in which a rotating body (fixing roller), such as a thin metallic belt, is caused to generate heat by induction heating.

Japanese Laid-Open Patent Publication No. 2006-154222 discloses a fixing device based on the electromagnetic induction heating method in which local heating is performed for heating a portion of a fixing roller in a circumferential direction, with a view to reducing warm-up time and energy saving.

In this device, during time in which execution of an image formation operation is awaited (hereinafter referred to as "standby time") i.e. when a fixing operation is not performed after the fixing roller reaches a predetermined temperature enabling the fixing operation, the temperature of the fixing roller is adjusted within a predetermined temperature range which is lower than a fixing temperature during image formation, and the fixing roller is rotated while performing the temperature adjustment, whereby the temperature of the fixing roller is prevented from becoming uneven in the circumferential direction and at the same time energy is saved during the standby time.

Further, in Japanese Laid-Open Patent Publication No. 2007-57672, for a fixing device that locally heats a fixing roller, there has been proposed a technique in which the rotation and temperature of the fixing roller are adjusted during the standby time for the purpose of reducing first print out time.

From the viewpoint of energy saving, it is essentially desirable to block power supply to components not required to operate in the standby state or stop operations thereof so as to reduce power consumption. However, in the above-described conventional device, the fixing roller is operated for rotation in the standby state, and hence it is required to operate many circuits, such as a motor, which is a drive unit, a control circuit for drivingly controlling the motor, a power unit for supplying electric power to the motor and the control circuit, and so forth. As a result, this consumes an amount of electricity nearly equal to that consumed during a normal image forming operation.

SUMMARY OF THE INVENTION

The present invention provides a fixing device which makes it possible to reduce power consumption during a non-fixing operation while reducing the time before fixing is started.

The present invention provides a fixing device for fixing a toner image transferred onto a member on which the toner image is to be fixed, comprising a fixing roller configured to have a conductive layer provided thereon, a pressure roller configured to rotate in a state engaged with the fixing roller to thereby cause the fixing roller to be rotated in a driven manner, an induction heating unit including a magnetic core and an exciting coil and configured to generate an eddy current in the conductive layer provided on the fixing roller to thereby cause heat to be generated in the conductive layer, and a control unit configured to control driving of the induction heating unit, wherein a plurality of the induction heating units are arranged at different locations along a rotational direction of the fixing roller, and wherein the control unit drivingly controls the plurality of induction heating units in respective timings in a state where the fixing roller and the pressure roller are disengaged from each other.

With the arrangement of the fixing device according to the present invention, it is possible to reduce power consumption during the non-fixing operation while reducing the time before fixing is started.

Further features of the present invention will become apparent from the following description of exemplary embodiments with reference to the attached drawings.

DETAILED DESCRIPTION OF THE EMBODIMENTS

The present invention will now be described in detail below with reference to the accompanying drawings showing embodiments thereof.

Figure 1:
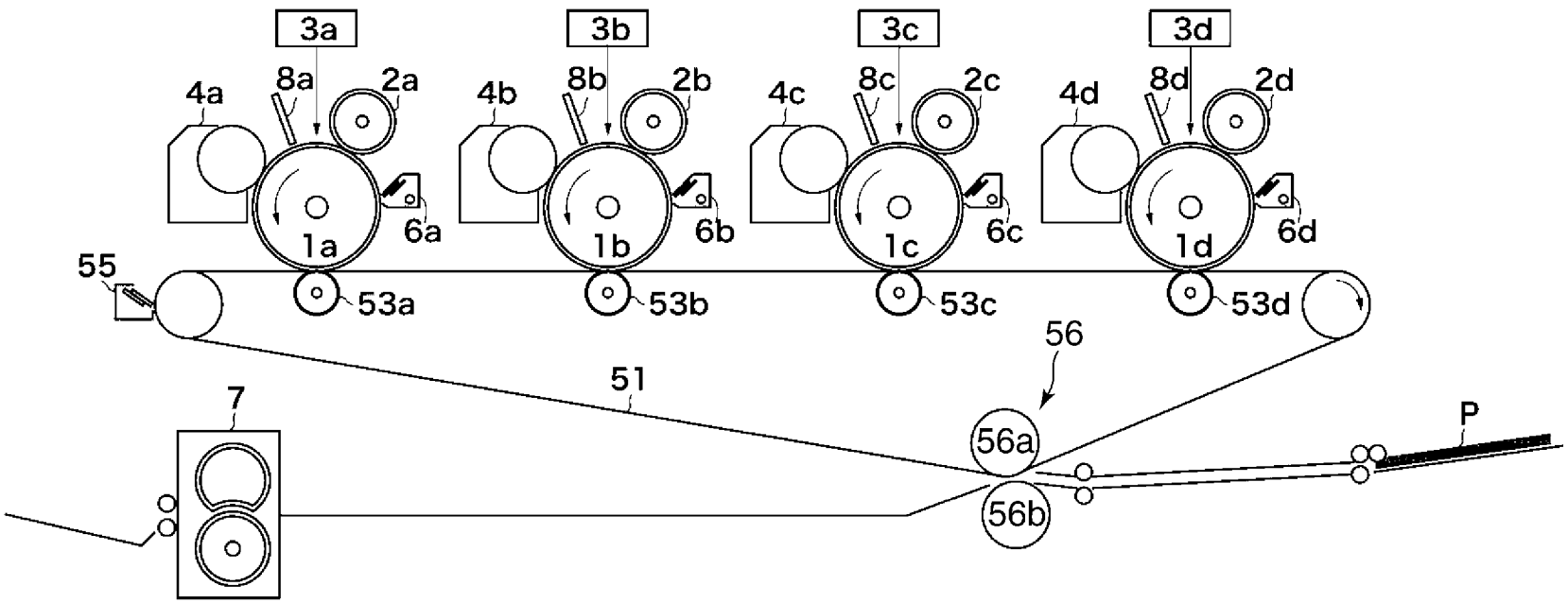
FIG. 1 is a schematic view of an image forming apparatus equipped with a fixing device according to a first embodiment of the present invention.

FIG. 1 is a schematic view of an image forming apparatus equipped with a fixing device according to a first embodiment of the present invention. This apparatus has at least the capability of fixing, and is configured, for example, as a tandem-type color image forming apparatus that performs an electrophotographic process.

The present apparatus includes four sets of photosensitive members 1 (1*a* to 1*d*), primary electrostatic chargers 2 (2*a* to 2*d*), exposure sections 3 (3*a* to 3*d*), development units 4 (4*a* to 4*d*), primary transfer sections 53 (53*a* to 53*d*), cleaners 6 (6*a* to 6*d*), and voltage sensors 8 (8*a* to 8*d*). The present apparatus further includes an intermediate transfer belt 51, an intermediate transfer belt cleaner 55, a secondary transfer section 56 (56*a* and 56*b*), and a fixing unit 7.

The four primary electrostatic chargers 2 uniformly charge the respective associated photosensitive members 1, and then the respective associated exposure sections 3 perform exposure according to image signals, to thereby form electrostatic latent images on the respective photosensitive members 1. Then, the respective associated development units 4 develop toner images, and the toner images on the respective photosensitive members 1 are multiply-transferred onto the intermediate transfer belt 51 by the respective associated primary transfer sections 53. Then, the multiply-transferred toner images are further transferred onto a recording sheet P by the secondary transfer section 56. Toner remaining on the photosensitive members 1 is collected by the respective associated cleaners 6, and toner remaining on the intermediate transfer belt 51 is collected by the intermediate transfer belt cleaner 55. The toner images transferred onto the recording sheet P as a member on which toner is to be fixed by the fixing unit 7 whereby a color image is obtained.

The fixing unit 7 employs an electromagnetic induction heating method. The electromagnetic induction heating method generates magnetic flux, using a magnetic flux generator, in a heating element that generates heat by electromagnetic induction, and heats the recording sheet P by Joule heat caused by an eddy current generated in the heating element, to thereby fix a toner image to be fixed.

Figure 2:
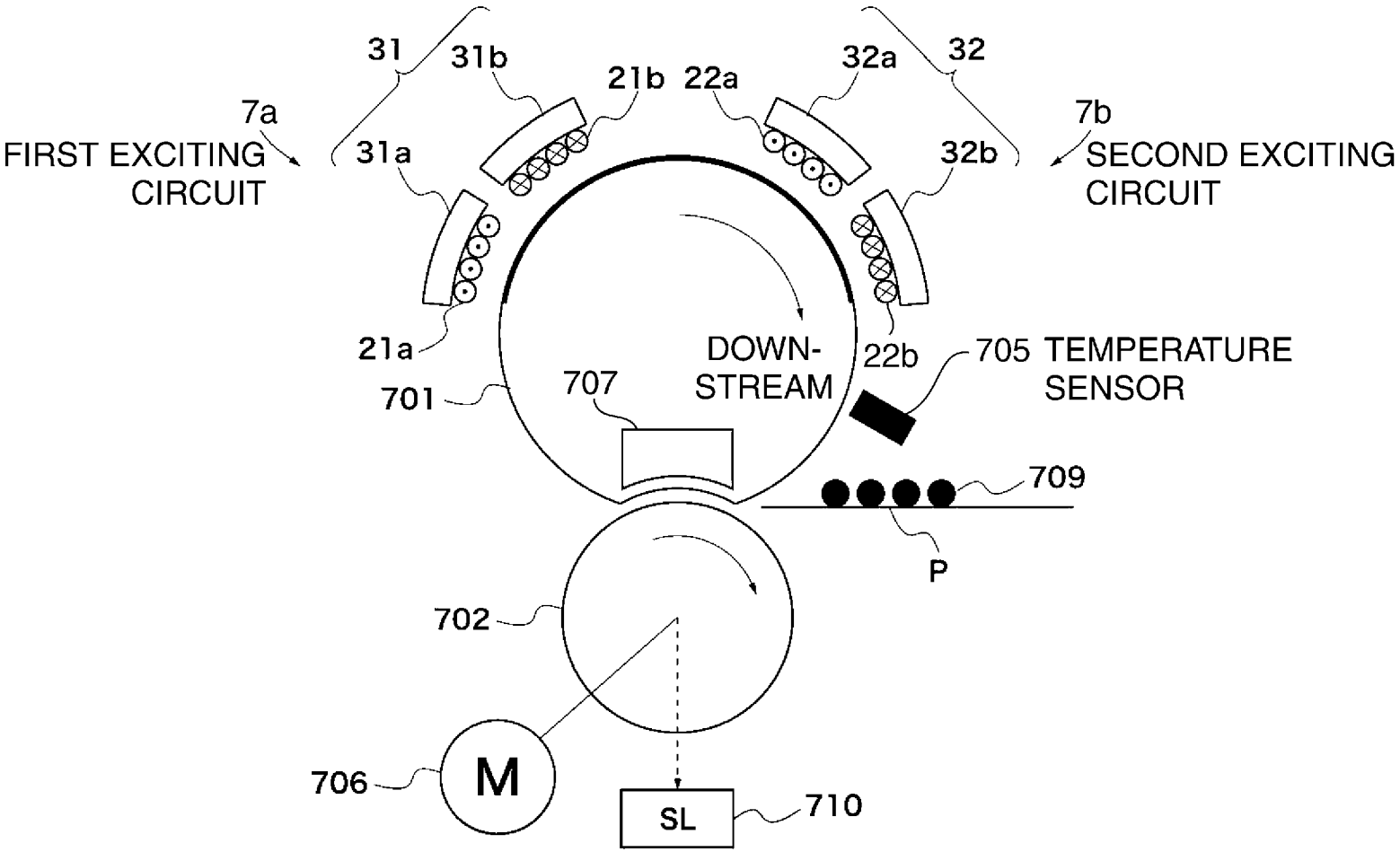
FIG. 2 is a schematic side view of a fixing unit during an image forming operation.
Figure 3:
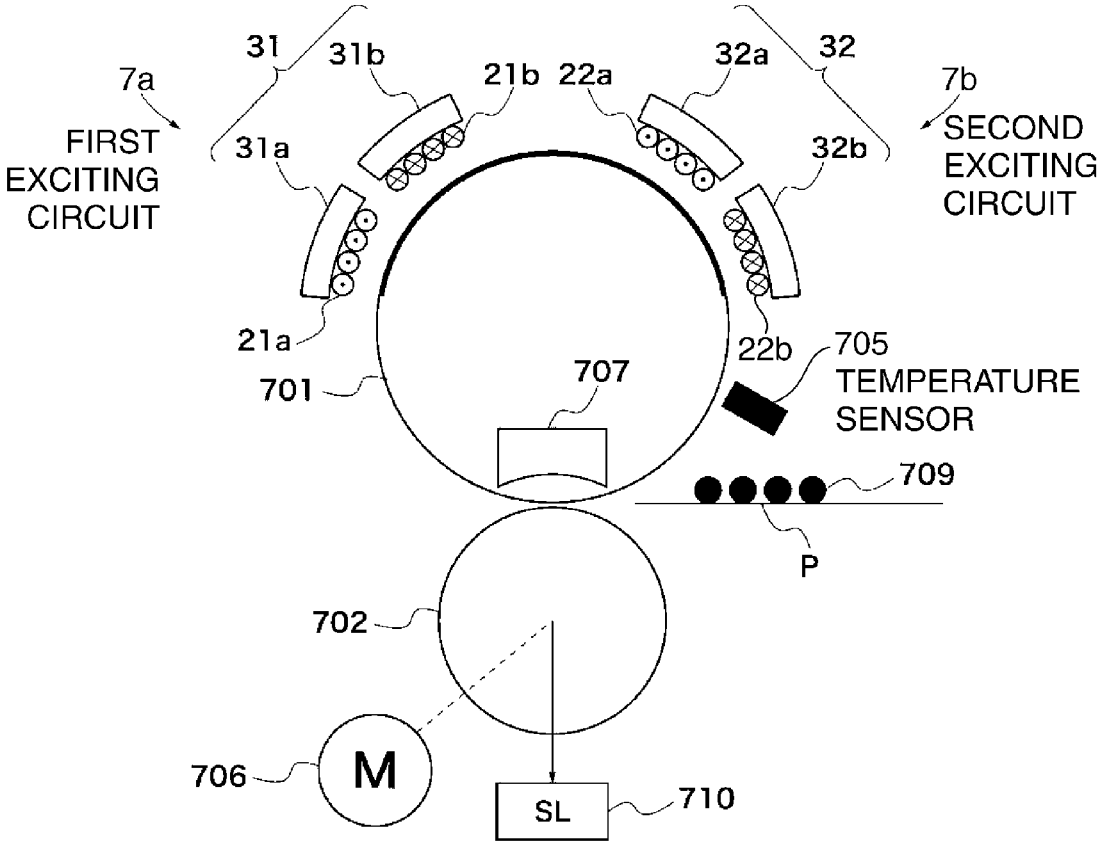
FIG. 3 is a schematic side view of the fixing unit during a standby time.

FIGS. 2 and 3 are schematic side views of the fixing unit 7. FIG. 2 shows a state of the fixing unit during an image forming operation, while FIG. 3 shows a state of the same during awaiting execution of an image formation operation (hereinafter referred to as "standby").

The fixing unit 7 comprises a belt 701 as a so-called fixing roller, a first exciting circuit 7*a*, a second exciting circuit 7*b*, a pressure device 707, a pressure roller 702, a drive unit 706, a solenoid 710, and a temperature sensor 705. The belt 701 is formed of thin metal such that it has a hollow cylindrical shape, and includes a conductive heating element (conductor) as a conductive layer, and this conductive heating element is heated. The conductive heating element may be provided in any of an outer layer, an inner layer, and an intermediate layer thereof.

The first exciting circuit 7*a* is formed by a first coil 21 (21*a* and 21*b*) and a first core 31 (31*a* and 31*b*). The second exciting circuit 7*b* is formed by a second coil 22 (22*a* and 22*b*), and a second core 32 (32*a* and 32*b*). The first exciting circuit 7*a* and the second exciting circuit 7*b* form "an induction heating unit" in the present invention. The first core 31 and the second core 32 form "a magnetic core" in the present invention. The first coil 21 and the second coil 22 form "an exciting coil" in the present invention. As described hereinafter, the belt 701 is rotated in a clockwise direction as viewed in FIGS. 2 and 3 at the time of execution of a fixing operation. A front side in the circumferential direction of the belt 701 in the direction of rotation thereof is referred to as the "downstream side". The first exciting circuit 7*a* and the second exciting circuit 7*b* are provided close to an outer peripheral surface of the belt 701, and the second exciting circuit 7*b* is disposed at a location downstream of the first exciting circuit 7*a*.

Figure 4:
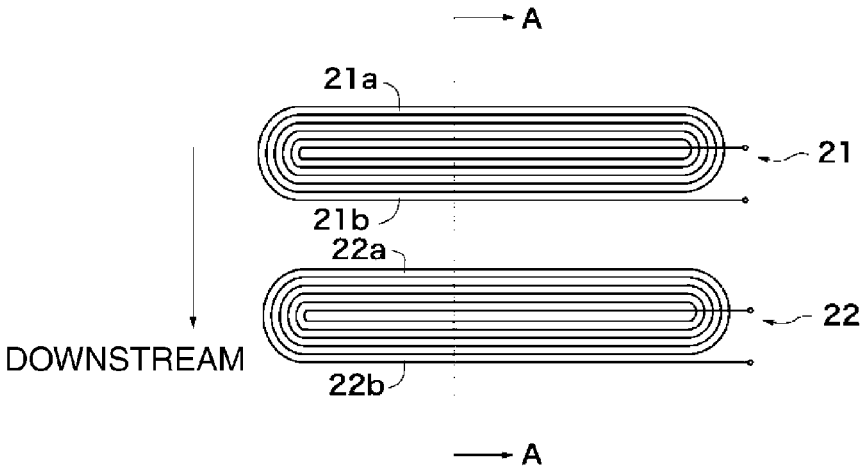
FIG. 4 is a view of a first coil of a first exciting circuit and a second coil of a second exciting circuit as taken from an outer periphery of a belt.

FIG. 4 is a view of the first coil 21 of the first exciting circuit 7*a* and the second coil 22 of the second exciting circuit 7*b* as taken from the outer periphery of the belt 701. A lower portion of each coil as viewed in FIG. 4 is a downstream portion in the direction of rotation of the belt 701. The first coil 21 and the second coil 22 are wound such that they extend long in the longitudinal direction of the belt 701. The views of the first exciting circuit 7*a* and the second exciting circuit 7*b* shown in FIGS. 2 and 3 correspond to a cross-section taken along A-A in FIG. 4.

In FIGS. 2 and 3, the first coil 21 is illustrated by a cross-section thereof, and hence is shown as an upstream bundle portion 21*a* and a downstream bundle portion 21*b*. The first core 31 is also illustrated in a similar manner, and hence is shown as an upstream half part 31*a* and a downstream half part 31*b*. The second coil 22 and the second core 32 are similarly shown as an upstream bundle portion 22*a* and a downstream bundle portion 22*b*, and an upstream half part 32*a* and a downstream half part 32*b*.

In the first exciting circuit 7*a* and the second exciting circuit 7*b*, when alternating currents flow from power units 102*a* and 102*b* (see FIG. 5) through the first coil 21 and the second coil 22, respectively, according to an operation mode, magnetic fields are generated. This causes eddy currents to be generated in the conductive heating element of the belt 701 according to the generated magnetic field, whereby heat is generated. The above-mentioned operation mode includes at least an image forming mode in which a fixing operation is performed and a standby mode in which the image forming apparatus is on standby without performing the fixing operation.

The temperature sensor 705 detects the surface temperature of the belt 701. In the image forming mode, alternating currents flowing through the first coil 21 and the second coil 22 are controlled by the above-mentioned power units 102*a* and 102*b*, respectively, based on a result of detection by the temperature sensor 705, whereby the surface temperature of the belt 701 is maintained constant. The drive unit 706 comprises a motor, not shown, and drives the pressure roller 702 for rotation. The pressure roller 702 is configured to be capable of being placed into respective states fitted to and removed from the belt 701, i.e. states engaged (brought into abutment or contact) with and disengaged from the belt 701. More specifically, a spring, not shown, constantly urges the pressure roller 702 in a direction away from the belt 701 with a weak force, and an operation for bringing the pressure roller 702 into contact with and away from the pressure roller 702 is performed by the solenoid 710. When the belt 701 is not engaged with the pressure roller 702, it has less portions in contact with parts around the belt 701. For this reason, the belt 701 is rotatable and is capable of starting rotation by a slight urging force.

As shown in FIG. 2, when the pressure roller 702 is brought into abutment with the belt 701 by driving the solenoid 710, the recording sheet P is sandwiched between the pressure device 707 and the pressure roller 702 together with the belt 701, and is pressurized. When the pressure roller 702 is rotated in the state where the pressure roller 702 is engaged with the belt 701 as above, the belt 701 is interlocked with the rotation of the pressure roller 702, and is rotated in a driven manner. When the recording sheet P on which a toner image 709 is formed is sandwiched between the pressure roller 702 and the belt 701, the recording sheet P is heated by heat of the belt 701, and at the same time is pressurized by the pressure device 707 and the pressure roller 702, whereby the toner image 709 is fixed on the recording sheet P.

FIG. 3 shows the pressure roller 702 in the state removed (disengaged) from the belt 701, and the pressure roller 702 is in this state not only during the standby mode but also during shutdown of the apparatus. Thus, during a time period during which it is not necessary to rotate the belt 701 by the drive unit 706, the drive unit 706 is stopped, and at the same time the pressure roller 702 is removed from the belt 701 by stopping the driving of the solenoid 710, whereby deformation or the like of the belt 701 is prevented.

Figure 5:
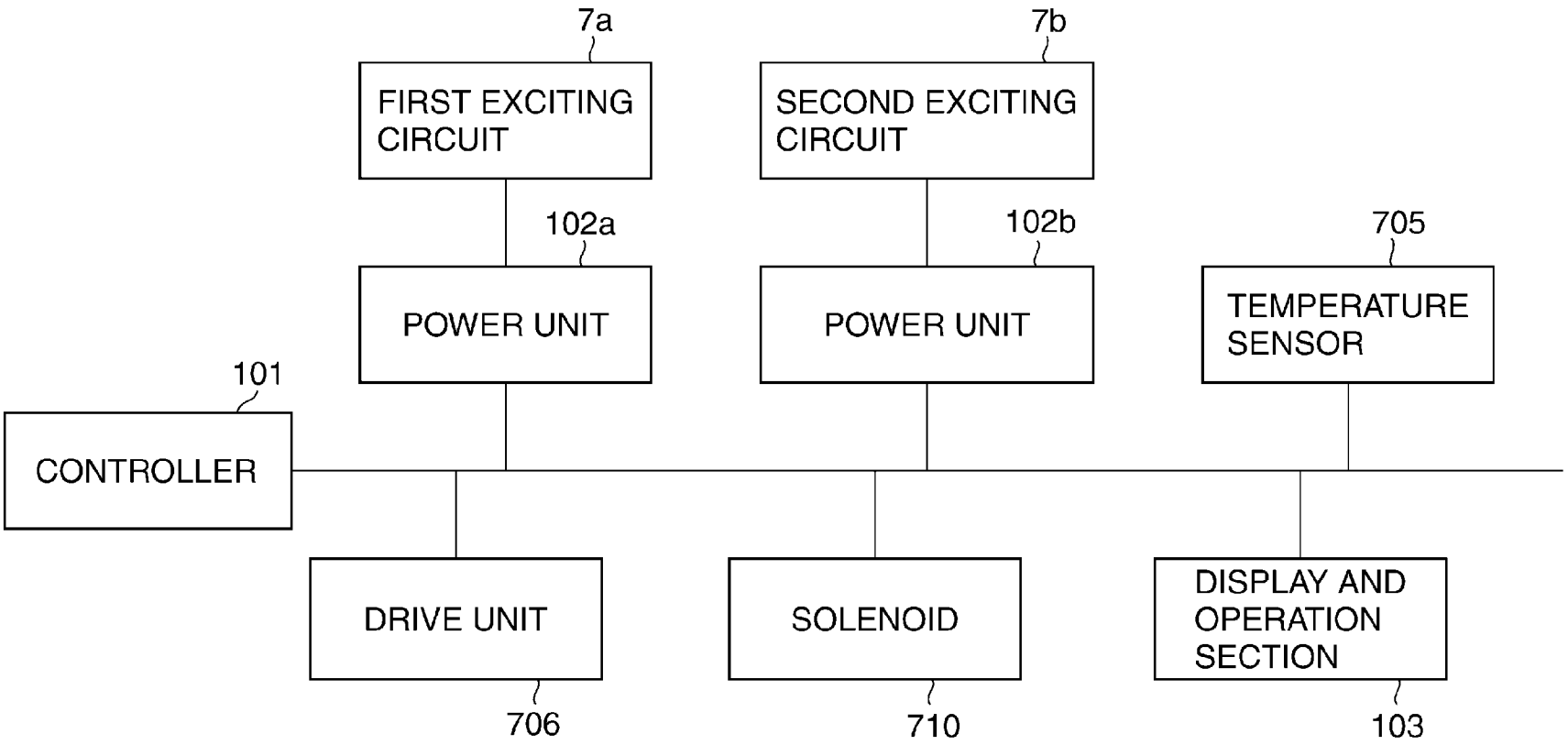
FIG. 5 is a block diagram of a control system of the fixing device.

FIG. 5 is a block diagram of a control system of the fixing device. This control system includes a controller 101 as a control unit. In addition to the above-mentioned temperature sensor 705, drive unit 706, and solenoid 710, the power unit 102*a* for driving the first exciting circuit 7*a*, the power unit 102*b* for driving the second exciting circuit 7*b*, and a display and operation section 103 are electrically connected to the controller 101. The controller 101 includes not only a CPU but also storage devices such as a RAM and a ROM (none of which are shown).

Next, a description will be given of the image forming mode out of the operation modes. Although in the present embodiment, a "copy mode" is described as the image forming mode, by way of example, this is not limitative. That is, the image forming mode can be applied to any mode other than the copy mode, insofar as it requires the fixing operation.

In the copy mode, an image forming operation is started based on a user's instruction from the display and operation section 103, and the component elements illustrated in FIG. 5 start respective operations by communication from the controller 101. The controller 101 controls engagement of the pressure roller 702 with the belt 701 caused by the solenoid 710 and at the same time controls the rotation of the belt 701 caused via the pressure roller 702 by the drive unit 706 (see FIG. 2). Further, the controller 101 controls the first exciting circuit 7*a* and the second exciting circuit 7*b* via the power units 102*a* and 102*b*, respectively, based on the result of detection by the temperature sensor 705 such that the surface temperature of the belt 701 is kept constant. During these controls, the controller 101 performs timing control according to an image forming operation sequence, ON/OFF operation control, and transmission and reception of control parameters, for the component elements connected thereto.

Next, a description will be given of an operation of the image forming apparatus in the standby mode. When it is not during an image forming operation, including during the standby mode, the controller 101 stops driving of the solenoid 710 to thereby cause the pressure roller 702 to be removed from the belt 701, i.e. disengaged from the same. Further, if it is required to perform temperature adjustment during the standby mode, the controller 101 causes the surface temperature of the belt 701 to be maintained at a fixed temperature (lower than a temperature during image formation) suitable for the standby mode, based on the result of detection by the temperature sensor 705. That is, the controller 101 controls the first exciting circuit 7*a* and the second exciting circuit 7*b* via the power units 102*a* and 102*b*, respectively.

In the present embodiment, particularly, through the control of the first exciting circuit 7*a* and the second exciting circuit 7*b*, a rotation force is generated in the belt 701 to thereby rotate the belt 701, whereby the whole surface of the belt 701 is controlled to a uniform temperature. A description will be given of a manner of driving the first exciting circuit 7*a* and the second exciting circuit 7*b* during the standby mode.

Figure 6:
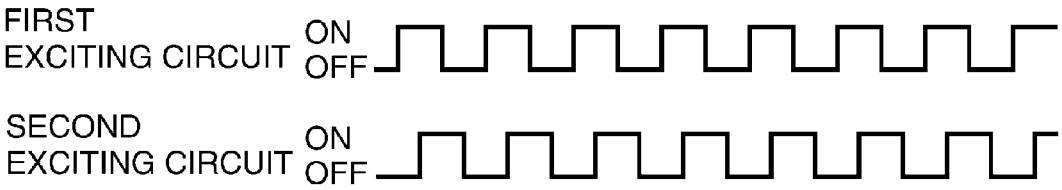
FIG. 6 is a diagram showing drive signal patterns of the first and second exciting circuits along the time axis.

FIG. 6 is a diagram showing drive signal patterns of the first exciting circuit 7*a* and the second exciting circuit 7*b* along the time axis. In the state where the belt 701 and the pressure roller 702 are disengaged from each other, the controller 101 can drivingly control the power units 102*a* and 102*b* independently of each other. Therefore, the controller 101 can perform driving (ON/OFF driving) of the exciting circuits 7*a* and 7*b* in pulses for ON/OFF of excitation in respective timings. Based on control signals delivered from the controller 101 during the standby mode, the power units 102*a* and 102*b* are operated.

In the above-mentioned image forming mode, the exciting circuits 7*a* and 7*b* are driven in phase. However, in the standby mode, differently from the image forming mode, as shown in FIG. 6, the exciting circuits 7*a* and 7*b* perform excitation operations in respective waveforms with a phase difference therebetween. Specifically, the controller 101 controls the exciting circuits 7*a* and 7*b* such that they repeatedly perform the excitation operations at a fixed frequency with a phase difference of $\pi/2$. That is, the second exciting circuit 7*b* performs an excitation operation with a phase $\pi/2$ retarded from the first exciting circuit 7*a*. The first exciting circuit 7*a* first performs an excitation operation. When the surface temperature of the belt 701 reaches a standby target temperature set for the standby mode, the excitation operations are stopped, whereas when the surface temperature becomes lower than the standby target temperature, the excitation operations with the above-mentioned phase difference are resumed. It should be noted that if only simplification of the configuration is intended, the excitation operations in the drive signal patterns shown in FIG. 6 may be continued, irrespective of the detected value of the surface temperature of the belt 701.

The two exciting circuits 7*a* and 7*b*, provided side by side, are operated in the waveforms with the above-mentioned phase difference, whereby the first exciting circuit 7*a* and the second exciting circuit 7*b* serve as a stator of a motor, and the belt 701 serves as a rotor of the same. This makes it possible to generate a rotation force in the belt 701 which is slightly loaded in the standby mode, as will be described hereafter.

Figure 7:
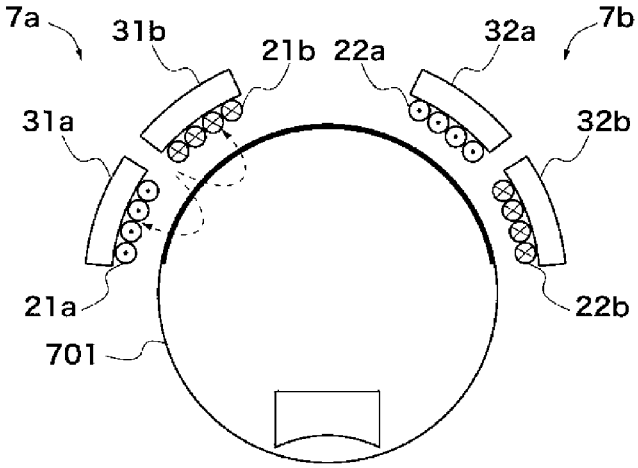
FIG. 7 is a view useful in explaining a rotational operation of the belt in a standby mode.
Figure 8:
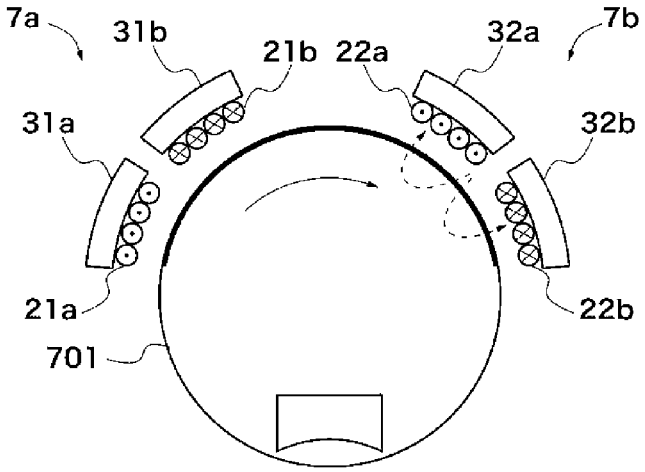
FIG. 8 is a view useful in explaining the rotational operation of the belt in the standby mode.

FIGS. 7 and 8 are views useful in explaining the rotational operation of the belt 701 in the standby mode. Some component elements are omitted from FIGS. 2 and 3.

First, when the first exciting circuit 7*a* is turned on, an eddy current flows through a portion (of the conductive heating element) of the belt 701, which is opposed to the first exciting circuit 7*a* (hereinafter referred to as the "opposed portion"), whereby a magnetic flux is generated by the action of electromagnetic induction (see FIG. 7). Then, at a time point the first exciting circuit 7*a* is turned off, an eddy current which prevents the generated magnetic flux from disappearing, i.e. an eddy current flowing in a direction opposite from that of the eddy current flowing in the on-state is temporarily generated in the "opposed portion". The second exciting circuit 7*b* is turned on before the first exciting circuit 7*a* is turned off (see FIG. 6). Therefore, at the time point the first exciting circuit 7*a* is turned off as shown in FIG. 6, the second exciting circuit 7*b* has already been turned on (see FIG. 8).

As a result, the "opposed portion" and the second exciting circuit 7*b* are caused to attract each other at that time point. This causes the "opposed portion" to be attracted toward the second exciting circuit 7*b*, whereby the belt 701 is rotated in a clockwise direction as viewed in FIG. 2.

To efficiently generate a rotation force in the belt 701 at rest, it is only required to satisfy the relationship between the first exciting circuit 7*a* and the second exciting circuit 7*b* that when one is turned off, the other is on, but the phase difference in driving the exciting circuits need not be limited to $\pi/2$.

Further, particularly, to efficiently generate a rotation force in the belt 701 at rest in the clockwise direction as viewed in FIG. 2, it is preferable to dispose the second exciting circuit 7*b* at a location within a rotational angle range smaller than 180° in the clockwise direction (toward the downstream side) from the location of the first exciting circuit 7*a* which is operated first.

As described above, the exciting circuits 7*a* and 7*b* act to cause the belt 701 at rest to start rotation. However, since eddy currents flow in (the conductive heating element of) the belt 701, the exciting circuits 7*a* and 7*b* also naturally act to cause the belt 701 to generate heat. During the process, since the belt 701 is rotated as mentioned above, uneven distribution of the generated heat is prevented. This makes it possible to uniformly heat the belt 701.

This is effective for properly maintaining the heated state in the standby mode. Particularly, since the pressure roller 702 need not be operated, it is possible to reduce power consumption, and further since no dedicated mechanism need be provided for rotating the belt 701, the construction of the present apparatus is prevented from being made unnecessarily complicated.

Figure 9:
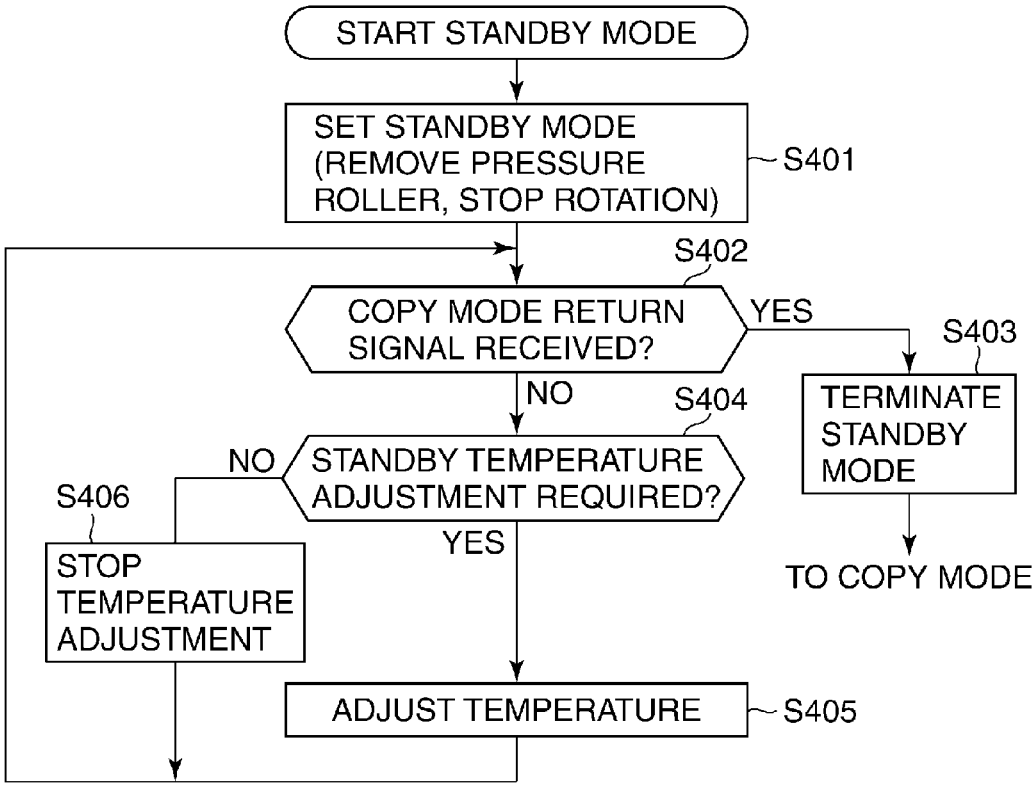
FIG. 9 is a flowchart of a fixing device control process executed in the standby mode.
Figure 10:
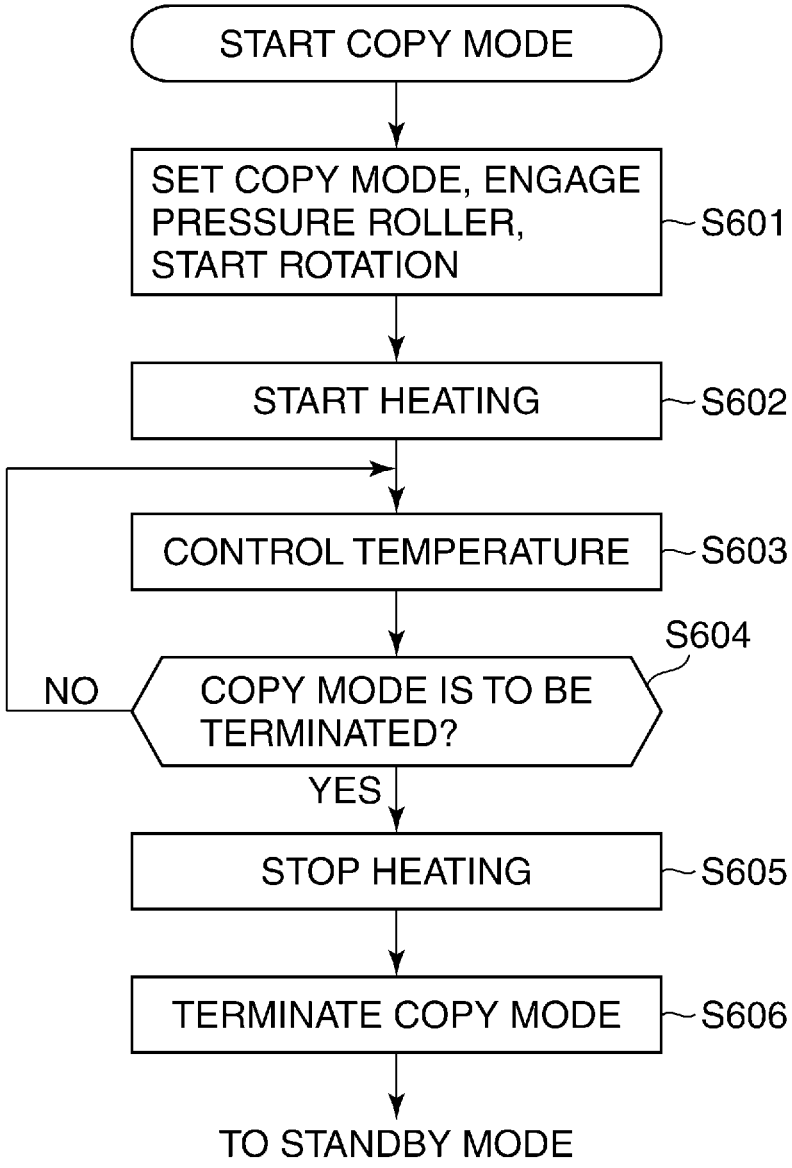
FIG. 10 is a flowchart of a fixing device control process executed in an image forming mode (copy mode).

FIG. 9 is a flowchart of a fixing device control process executed in the standby mode. FIG. 10 is a flowchart of a fixing device control process executed in the image forming mode (copy mode). The fixing device control process in FIG. 9 is started immediately after power-on of the present apparatus, and the fixing device control process in FIG. 10 is started after executing a step S403, referred to hereinafter, of the fixing device control process in FIG. 9. The fixing device control process in FIG. 9 is started again after executing a step S606, referred to hereinafter, of the fixing device control process in FIG. 10.

First, in a step S401 in FIG. 9, the controller 101 performs setting of the standby mode. That is, the controller 101 stops driving of the solenoid 710 to thereby cause the pressure roller 702 to be removed (disengaged) from the belt 701, and turns off the drive unit 706 to thereby stop rotation of the pressure roller 702.

Next, in a step S402, the controller 101 checks whether or not a copy mode return signal is received, and if the copy mode return signal is received, the controller 101 terminates the standby mode (step S403), and then proceeds to the fixing device control process in the copy mode in FIG. 10.

On the other hand, if the copy mode return signal is not received, the controller 101 determines in a step S404 whether or not a temperature adjustment signal is received to thereby determine whether or not temperature adjustment is required in the standby mode. Although the temperature adjustment signal is generated e.g. by a setting based on a user's instruction, this is not limitative. Then, if temperature adjustment is required, the controller 101 executes the temperature adjustment control in the standby mode in a step S405. In the temperature adjustment control, the controller 101 drives the power unit 102*a* and the power unit 102*b* to excite the first exciting circuit 7*a* and the second exciting circuit 7*b* such that the surface temperature of the belt 701, detected by the temperature sensor 705, becomes equal to the above-mentioned standby target temperature. A manner of driving these circuits for excitation is the manner of driving with the phase difference as illustrated in FIG. 6.

On the other hand, as a result of the determination in the step S404, if temperature adjustment is not required, the controller 101 stops the temperature adjustment control in a step S406. Thai is, the controller 101 stops the operation for exciting the first exciting circuit 7*a* and the second exciting circuit 7*b*. After executing the step S405 or the step S406, the controller 101 returns to the step S402.

It should be noted that the process may be configured such that the steps S404 and S406 are eliminated, whereby the temperature adjustment control in the standby mode in the step S405 may be executed without exception until the copy mode return signal is received.

Next, a description will be given of an operation when image formation is performed. First, in a step S601 in FIG. 10, the controller 101 performs setting of the copy mode. That is, the controller 101 drives the solenoid 710, thereby causing the pressure roller 702 to be engaged with the belt 701, and turns on the drive unit 706, thereby causing the pressure roller 702 to start rotation.

Next, in a step S602, the controller 101 starts heating the belt 701. That is, the controller 101 drives the power unit 102*a* and the power unit 102*b*, thereby starting exciting the first exciting circuit 7*a* and the second exciting circuit 7*b*.

Next, in a step S603, the controller 101 performs temperature control such that the surface temperature of the belt 701 becomes equal to a predetermined temperature determined according to conditions of the fixing unit 7 in the copy mode. The temperature control is realized by the manner of driving the power unit 102*a* and the power unit 102*b*, as described hereinabove.

Next, in a step S604, the controller 101 determines whether or not the operation in the copy mode is completed, i.e. the copy mode should be terminated, and if the answer to this question is negative (NO), the controller 101 continues the step S603 until the copy mode should be terminated. Then, if the copy mode should be terminated, the controller 101 stops driving the power unit 102*a* and the power unit 102*b*, thereby stopping heating the belt 701 in a step S605.

Thereafter, in the step S606, the controller 101 terminates the copy mode, and proceeds to the fixing device control process in the standby mode in FIG. 9.

According to the present embodiment, the first exciting circuit 7*a* and the second exciting circuit 7*b* are provided at different locations along the rotational direction of the belt 701, and are controlled for ON/OFF of excitation in respective timings. This enables the first exciting circuit 7*a* and the second exciting circuit 7*b* to perform the function of rotating the belt 701 while heating the same without operating the pressure roller 702 when the fixing unit 7 is performing the non-fixing operation (on standby). Therefore, during the non-fixing operation of the fixing unit 7, it is possible to reduce power consumption while shortening the time before the start of fixing.

Particularly, the exciting circuits 7*a* and 7*b* are driven with a phase difference therebetween, and hence even when the belt 701 is at rest, it is possible to generate the rotation force in the belt 701 by generation of eddy currents which vary in time and position, and thereby make it possible to efficiently rotate the belt 701.

Next, a second embodiment of the present invention will be described. In the first embodiment, if the temperature adjustment is required in the standby mode, the temperature adjustment control based on the drive signal patterns shown in FIG. 6 is executed and is continued in the step S405 in FIG. 9. In contrast, in the second embodiment of the present invention, once the temperature adjustment control is started, then when the rotation of the belt 701 becomes stable, the drive signal patterns are switched to those for intermittent drive control, shown in FIG. 11. The other arrangement and configuration are the same as those of the first embodiment. Therefore, a description will be given of different points of the second embodiment from the first embodiment with reference to FIG. 11.

Figure 11:
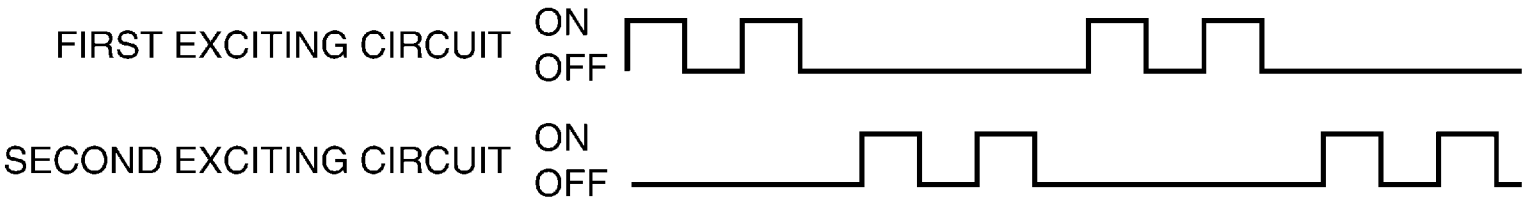
FIG. 11 is a diagram of drive signal patterns of the first and second exciting circuits along the time axis after the rotation of a belt of an image forming apparatus equipped with a fixing device according to a second embodiment of the present invention becomes stable.

FIG. 11 is a diagram of drive signal patterns of the first exciting circuit 7*a* and the second exciting circuit 7*b* along the time axis after rotation of the belt 701 becomes stable, employed in the second embodiment.

Although at the start of the image forming apparatus, the operation of rotating the belt 701 is performed in the above-mentioned drive signal patterns shown in FIG. 6, and thereafter, to continue the rotational operation after the operation of rotating the belt 701 has become stable, the belt 701 is enabled to rotate by the driving patterns shown in FIG. 11 which are simpler than those at the time of the start of the apparatus.

The drive signal patterns illustrated in FIG. 11 show intermittent waveforms for driving the first exciting circuit 7*a* and the second exciting circuit 7*b*, which have respective drive pulse portions having a predetermined number of pulses and different from those during the image forming operation and respective predetermined idle periods, with a predetermined phase difference therebetween. Specifically, the waveforms each have two pulses and an idle period therebetween. Each two-pulse waveform portion of the first exciting circuit 7*a* and each two-pulse waveform portion of the second exciting circuit 7*b* appear in an alternating manner, with a time difference.

The drive patterns shown in FIG. 11 also cause the first exciting circuit 7*a* and the second exciting circuit 7*b* to serve as a stator of a motor, and the belt 701 to serve as a rotor of the motor. This makes it possible to generate the rotation force in the rotating belt 701, and maintain the rotation, and what is more, it is possible to uniformly heat the belt 701 by heating the belt 701 simultaneously when the rotation force is applied to the belt 701.

Further, compared with the drive signal patterns shown in FIG. 6, each waveform has an idle period, and hence it is possible to perform control in a manner suppressing the heating of the belt.

The controller 101 performs the control, for example, as follows: In the step S405 in FIG. 9, after the temperature adjustment control in the drive signal patterns shown in FIG. 6 is started, the controller 101 measures elapsed time. Then, when a predetermined time period has elapsed, the controller 101 estimates that the rotation of the belt 701 becomes stable, and switches the drive signal patterns to those shown in FIG. 11. It should be noted that instead of switching the drive signal patterns based on the elapsed time, the switching of the drive signal patterns may be performed in such a manner that the rotational speed of the belt 701 is measured, and when it is detected that a predetermined rotational speed has continued for a predetermined time period, the drive signal patterns are switched to those shown in FIG. 11.

According to the present embodiment, it is possible not only to obtain the same advantageous effects as provided by the first embodiment, but also to maintain the rotation of the belt 701 by simplified drive control and further reduce power consumption.

Next, a third embodiment of the present invention will be described. Although in the above-mentioned first embodiment, two exciting circuits, i.e. the first exciting circuit 7*a* and the second exciting circuit 7*b* are provided as the induction heating unit, the number of exciting circuits is not limited to two, but it is only required to provide a plurality of exciting circuits at different locations along the rotational direction of the belt 701. For example, three or more exciting circuits may be provided. The third embodiment of the present invention shows an arrangement having three induction heating units.

Figure 12A:
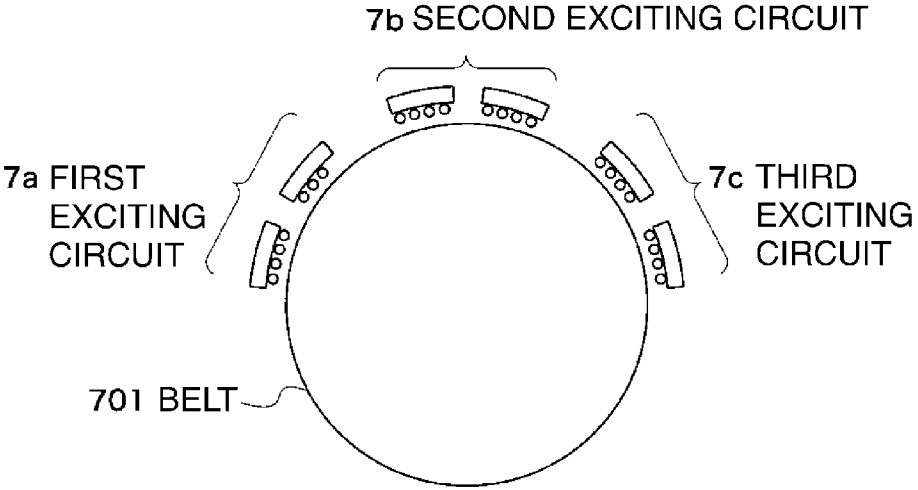
FIG. 12A is a schematic side view of a fixing unit of an image forming apparatus equipped with a fixing device according to a third embodiment of the present invention.
Figure 12B:
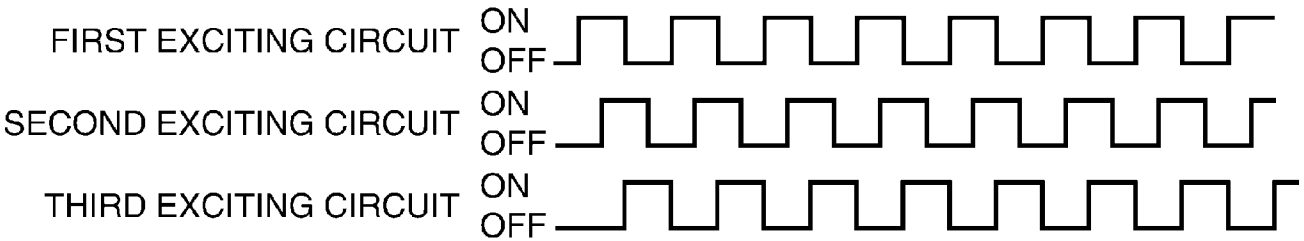
FIG. 12B is a diagram of drive signal patterns of the first and second exciting circuits along the time axis, employed in the third embodiment.

FIG. 12A is a schematic side view of the fixing unit 7 in the third embodiment, in which the component elements other than the belt 701 and the induction heating units are omitted. FIG. 12B is a diagram of drive signal patterns of the first exciting circuit 7*a*, the second exciting circuit 7*b*, and a third exciting circuit 7*c* along the time axis, in the third embodiment. As for the arrangement of the fixing unit 7, FIG. 12A is employed instead of FIGS. 2, 3, 7, and 8, and as for the exciting patterns of the exciting circuits 7*a* and 7*b*, FIG. 12B is employed instead of FIG. 6. The other arrangement and configuration are the same as those of the first embodiment.

As shown in FIG. 12A, in addition to the first exciting circuit 7*a* and the second exciting circuit 7*b*, the third exciting circuit 7*c* is disposed close to the outer periphery surface of the belt 701. The second exciting circuit 7*b* is provided at a location downstream of the first exciting circuit 7*a*, and the third exciting circuit 7*c* is provided at a location further downstream of the second exciting circuit 7*b*. The third exciting circuit 7*c* is formed by a coil and a core, similarly to the first exciting circuit 7*a* and the second exciting circuit 7*b*.

As shown in FIG. 12B, by the control performed by the controller 101, the exciting circuits 7*a*, 7*b*, and 7*c* perform excitation operations in respective waveforms with phase differences therebetween. Specifically, the second exciting circuit 7*b* repeatedly performs its excitation operation at a fixed frequency with a phase difference retarded from the first exciting circuit 7*a* by $\pi/2$. The third exciting circuit 7*c* repeatedly performs its excitation operation at a fixed frequency with a phase difference retarded from the second exciting circuit 7*b* by $\pi/2$.

With the above-described configuration, at a time point the first exciting circuit 7*a* is turned off, the second exciting circuit 7*b* has already been turned on. As a result, similarly to the first embodiment, a portion of the belt 701, which is opposed to the first exciting circuit 7*a*, is attracted toward the second exciting circuit 7*b*, whereby the belt 701 receives the rotation force in the clockwise direction. Further, at a time point the second exciting circuit 7*b* is turned off, the third exciting circuit 7*c* has already been turned on. As a result, a portion of the belt 701, which is opposed to the second exciting circuit 7*b*, is attracted toward the third exciting circuit 7*c*, whereby the belt 701 receives the rotation force in the clockwise direction. Thus, the belt 701 is rotated in the clockwise direction.

According to the present embodiment, it is possible to obtain the same advantageous effects as provided by the first embodiment.

It should be noted that in the present embodiment, the relationship between the phase differences and the locations of the exciting circuits 7*a*, 7*b*, and 7*c* is not limited to the illustrated example. To efficiently generate the rotation force in the belt 701 at rest, it is only required to provide control such that at a time point one of the exciting circuits 7*a*, 7*b*, and 7*c* is turned off, an adjacent one of them at a downstream location has already been turned on.

With a view to more reliable generation of the rotation force in the belt 701 in the clockwise direction, the locations of the exciting circuits 7*a*, 7*b*, and 7*c* may be arranged within an angle range of 180° from each other. For example, the exciting circuits 7*a*, 7*b*, and 7*c* may be arranged at equally-spaced intervals.

Figure 13A:
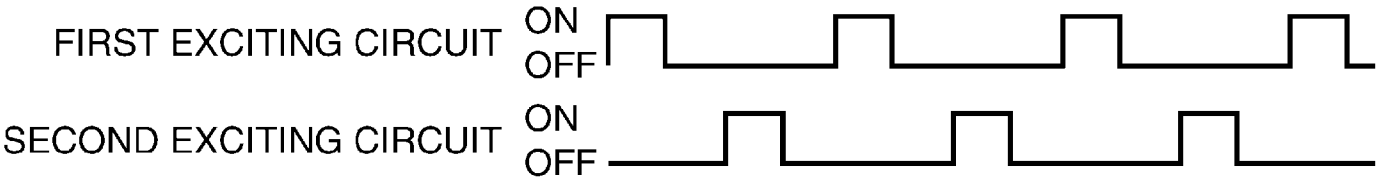
FIGS. 13A and 13B are diagrams of drive signal patterns of the first and second exciting circuits along the time axis after the rotation of the belt becomes stable, employed in a variation of the second embodiment.

By the way, although in the drive signal patterns shown in FIG. 11, used in the second embodiment, the waveform portions appearing in an alternating manner in the first exciting circuit 7*a* and the second exciting circuit 7*b* are two-pulse waveform portions, they may be one-pulse portions as shown in FIG. 13A. Alternatively, they may be waveform portions of which the number of pulses is three or more.

Further, the arrangement in which three exciting circuits is provided as shown in FIG. 12A can be applied to the second embodiment. In this case, for example, it is only required to switch the drive signal patterns from those shown in FIG. 12B to those for the intermittent drive control shown in FIG. 13B, when the rotation of the belt 701 becomes stable. The waveform portions appearing in the drive signal patterns of the respective exciting circuits may be one-pulse waveform portions similarly to those in FIG. 13A, or may be waveform portions of which the number of pulses is three or more.

Figure 13B:
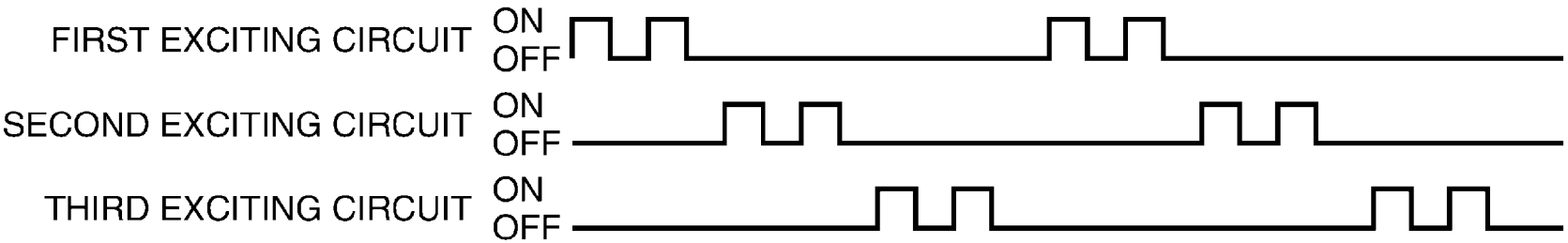

After all, to reduce power consumption, compared with initial drive signal patterns (see FIGS. 6 and 12B) for applying a rotation force to the belt 701, drive signal patterns required for maintaining the rotation after the rotation of the belt 701 becomes stable are only required to satisfy the following conditions: The controller 101 drivingly controls the exciting circuits such that the respective exciting circuits are less frequently turned on than in the initial drive signal patterns (see FIGS. 6 and 12B), and at the same time, the time periods during which the respective exciting circuits are on do not overlap each other. FIGS. 11, 13A, and 13B show the examples of the drive signal patterns.

It should be noted that in the above-described embodiments, although the controller 101 drivingly controls the exciting circuits in respective timings in the state where the belt 701 and the pressure roller 702 are disengaged from each other, the manner of the control is not limited to the above-described example. The excitation operation of the exciting circuits is not limited to the ON/OFF operation. That is, in the standby mode, it is only required to control the excitation of the exciting circuits such that a rotation force is generated in the belt 701 at rest for starting rotation thereof. Then, in the standby mode, it is only required to control the excitation of the exciting circuits such that the rotation of the belt 701 of which the rotation has become stable can be maintained.

It should be noted that although in the above-described embodiments, the exciting circuits (7*a*, 7*b*, and 7*c*) are disposed close to the outer peripheral surface of the belt 701, the exciting circuits may be provided close to an inner peripheral surface of the belt 701.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-201495, filed Sep. 1, 2009, which is hereby incorporated by reference herein in its entirety.

What is claimed is:

1. A fixing device for fixing a toner image transferred onto a sheet, comprising:

a fixing roller configured to have a conductive layer provided thereon;

a pressure roller configured to rotate in a state engaged with said fixing roller to thereby cause said fixing roller to be rotated in a driven manner;

an induction heating unit including a magnetic core and an exciting coil and configured to generate an eddy current in said conductive layer provided on said fixing roller to thereby cause heat to be generated in said conductive layer; and a control unit configured to control driving of said induction heating unit, wherein a plurality of said induction heating units are arranged at different locations along a rotational direction of said fixing roller, and wherein in a state where said fixing roller and said pressure roller are disengaged from each other, said control unit drives said plurality of induction heating units with a phase difference therebetween to thereby cause a rotation force to be generated in said fixing roller.

2. The fixing device according to claim 1, wherein in the state where said fixing roller and said pressure roller are disengaged from each other, said control unit performs on/off-driving of each of said plurality of induction heating units, to thereby perform control such that at a time point one induction heating unit of said plurality of induction heating units is turned off, an adjacent induction heating unit provided at a location downstream of said one induction heating unit in the rotational direction of said fixing roller has been turned on.

3. The fixing device according to claim 2, wherein in the state where said fixing roller and said pressure roller are disengaged from each other, after said fixing roller starts rotation, said control unit switches drive control of said plurality of induction heating units from control for driving said induction heating units with the phase difference to intermittent drive control for driving said induction heating units such that said induction heating units are less frequently turned on than in the control for driving said induction heating units with the phase difference, and at the same time, time periods during which said respective induction heating units are on are do not overlap each other.

4. The fixing device according to claim 1, wherein said control unit controls said pressure roller such that a rotational operation thereof is stopped in the state where said fixing roller and said pressure roller are disengaged from each other.

* * * * *